US007044449B2

(12) United States Patent
Wink

(10) Patent No.: US 7,044,449 B2
(45) Date of Patent: May 16, 2006

(54) APPARATUS AND METHOD FOR SUPPORTING ROLL-UP SAFETY FENCING

(76) Inventor: Dwayne Wink, 4270 Rendon Rd., Ft. Worth, TX (US) 76140

( * ) Notice: Subject to any disclaimer, the term of this patent is extended or adjusted under 35 U.S.C. 154(b) by 112 days.

(21) Appl. No.: 10/798,176

(22) Filed: Mar. 11, 2004

(65) Prior Publication Data

US 2005/0199865 A1 Sep. 15, 2005

(51) Int. Cl.
*E01F 7/02* (2006.01)

(52) U.S. Cl. ..... 256/24; 256/12.5; 256/32; 256/DIG. 6; 248/156; 248/530

(58) Field of Classification Search ..... 256/1, 256/12.5, 19, 21, 24, 32, DIG. 6; 160/351, 160/380; 248/156, 530; 52/165
See application file for complete search history.

(56) References Cited

U.S. PATENT DOCUMENTS

| | | | | |
|---|---|---|---|---|
| 114,057 A | | 4/1871 | Sisson | |
| 209,303 A | | 10/1878 | Stanley | |
| 385,531 A | | 7/1888 | Shrader | |
| 1,226,465 A | * | 5/1917 | Campbell | 256/52 |
| 1,450,644 A | * | 4/1923 | Pracht | 256/52 |
| 1,582,574 A | * | 4/1926 | Carlson | 256/12.5 |
| 1,943,018 A | | 1/1934 | Hench | 189/28 |
| 3,519,234 A | * | 7/1970 | Matson | 248/156 |
| 4,279,104 A | | 7/1981 | Classen | 52/38 |
| 4,483,506 A | | 11/1984 | Litwiller | 248/545 |
| 4,971,479 A | | 11/1990 | Byers, Sr. et al. | 405/232 |
| 5,182,889 A | | 2/1993 | Johnson | 52/289 |
| 5,660,505 A | * | 8/1997 | Emory, III | 256/12.5 |
| 5,722,205 A | | 3/1998 | Gannaway | 52/155 |

* cited by examiner

*Primary Examiner*—Daniel P. Stodola
*Assistant Examiner*—Michael P. Ferguson
(74) *Attorney, Agent, or Firm*—Stephen S. Mosher

(57) ABSTRACT

A reusable fence post for supporting roll-up safety fencing comprises an elongated hollow post having an outside V-angle disposed along a first exterior side of the hollow post; a stake extending downward from a built-in sliding hammer for installing the reusable fence post in the ground without tools; and an elongated jaw member having an inside V-angle hinged at the lower end of the hollow post. The elongated jaw member swings away from the hollow post to receive the plastic fencing and swings toward the hollow post to be latched to the hollow post and held between inside and outside V-angle clamping surfaces, thereby securely clamping the safety fencing to prevent it from slipping either lengthwise or across the width of the fencing. In an alternate embodiment, the outside V-angle serves as the fence post; and the stake, having a cap at its upper end, slides within pipe sections attached to the post.

31 Claims, 7 Drawing Sheets

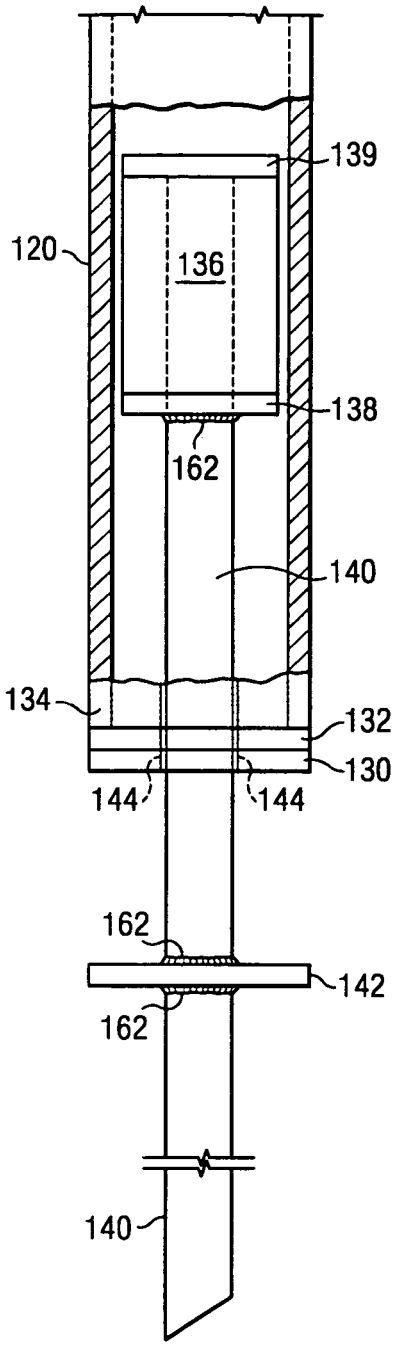
FIG. 3B
FIG. 3A
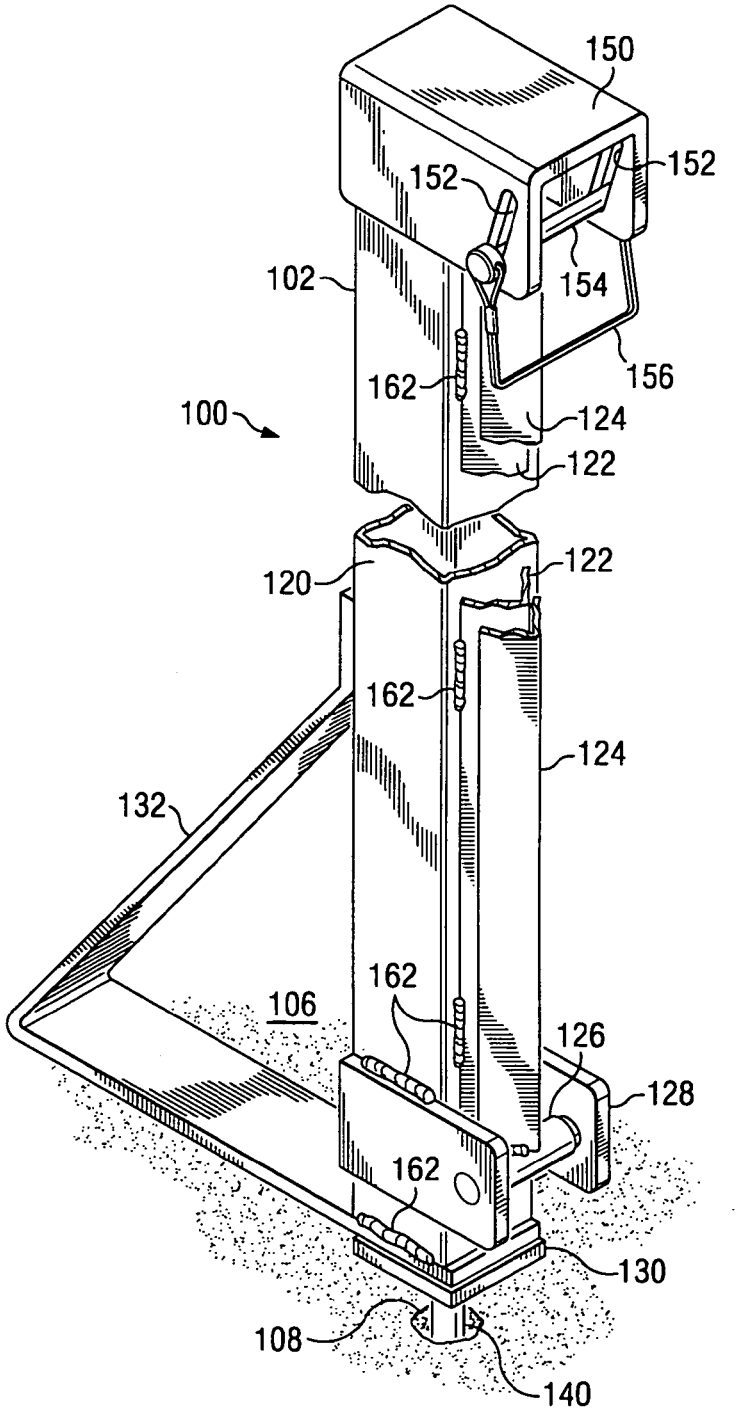

APPARATUS AND METHOD FOR SUPPORTING ROLL-UP SAFETY FENCING

BACKGROUND OF THE INVENTION

1. Field of the Invention

The present invention generally relates to fence posts and, more particularly, to a reusable fence post adapted to supporting roll-up fencing and a method of erecting the roll-up fencing.

2. Description of the Prior Art

Self-driving posts that are installable by one person have been known in the art for many years as solutions to the problem of installing fence posts or sign posts quickly without the use of tools or assistance by other persons. In the prior art, some posts are configured for enclosing a stake that slides within the post wherein the post is used as a ram to hammer the stake into the ground or to extract the stake by thrusting the post forcefully upward against a stop on the stake. Further, some prior art fence post designs are known having a two-piece post assembly wherein a first one of the two parallel, elongated and adjoining pieces pivots away from one end of the second piece of the post for receiving a wire fence or the slats of a fence between the two pieces of the post. Either or both of the pieces may have slots for supporting the fence material, which is typically stiff and has the ability to maintain its shape, even when not supported at more than a few locations along its width or length. In use, the first, pivoting piece of the post is then generally brought toward and secured to the second piece to enclose the fence material.

A relatively new kind of fence material is a thin, flexible, plastic fencing that is typically supplied in 50 foot or 100 foot rolls and may be four feet wide. This fencing material, in one typical product supplied by Tenax Corporation, Baltimore, Md. 21205, is formed of high density polyethylene (HDPE) plastic, which provides a strong yet lightweight fencing that is well suited for use in a variety of applications, particularly as a safety barrier around construction sites and excavations. Its light weight and flexibility makes it easy to handle by work crews.

However, a significant problem is presented by the flexibility and light weight of the plastic fencing material. The plastic fencing material, being thin (e.g., about 20 mils thick) very flexible, lacks the stiffness needed to maintain its shape when supported by conventional fence posts unless unusual effort and often extra materials are required to secure the plastic fencing to the posts at many places along its length as well as across its width. The result is that substantial time is required to erect such a fence, or worse, a fence is erected haphazardly because there is no convenient way to properly support the fencing material. This inconvenience of installation often results in the collapse of the fencing and the loss of its effectiveness as a safety barrier. Moreover, there is currently no known fence post that prevents the plastic fencing from slipping in both the lengthwise and crosswise directions. Slippage of this kind is one of the causes of collapse of this type of fencing. Improvised posts and unsatisfactory methods of attaching the plastic fencing to the posts are other causes of collapsed fencing.

What is needed is a fence post that may be installed without tools by one person, that is durable and reusable, and that is adapted to fully support and retain flexible plastic safety fencing in its proper position without the use of tools or any additional parts or components to secure the fencing to the fence posts.

SUMMARY OF THE INVENTION

Accordingly there is disclosed a reusable fence post for supporting flexible plastic safety fencing around an excavation or construction site, comprising a hollow post having an outside V-angle clamping surface on one side of the post to form a fixed jaw; a stake extending downward from and attached to the lower end of a sliding hammer that slides freely up and down within the hollow post wherein the stake extends downward through an opening in the bottom end of the hollow post and wherein a lower stop collar is secured around and approximately bisecting the length of the stake; and an elongated, movable jaw, having an inside V-angle clamping surface facing the outside V-angle clamping surface, the elongated jaw member being hinged at the lower end to the hollow post, allowing the upper end of the elongated jaw member to swing in an arc to close the elongated jaw against the safety fencing held between the inside and outside V-angle clamping surfaces, thereby clamping the safety fencing securely therebetween. When the safety fencing is thus clamped, the outside V-angle clamping surface of the first exterior side of the hollow post is positioned in a nesting relationship with the inside V-angle clamping surface of the elongated jaw member, supporting the flexible safety fencing across its full width, against both lengthwise and crosswise slippage. A latching mechanism is provided at the top of the hollow post to retain the elongated jaw in position against the hollow post. A buttress brace or foot may extend from the bottom of the hollow post on the side opposite the fixed jaw to stabilize the hollow post against the tension exerted by the safety fencing surrounding the excavation or construction site.

In one alternate embodiment, the hollow fence post is replaced with a length of angle iron having at least two pipe sections, the uppermost one closed at its upper end with a cap and attached to a midpoint of the angle iron post, and the lowermost one attached to the lower end of the post. An elongated jaw, also formed of angle iron, is hingeably attached to the lower end of the angle iron post. The two angle iron or inside and outside V-angle sections function as described in the embodiment above, securing the plastic fencing between a pair of angle iron surfaces in a nesting relationship to prevent slippage of the fencing material. The uppermost one of the pipe sections receives the upper end of the stake. The stake includes a stop collar at a midpoint of its length, disposed below the lower end of the post. The post forms a hammer that slides downward along the stake to strike the stop collar and drive the stake into the ground. In a modification to this embodiment, a rod having a male ACME thread at its lower end is attached to the inside "V" of the angle iron post. The ACME thread of the rod may be mated with a female thread on the top portion of a stake or on the upper side of a stand or base.

In another alternate embodiment, a stand is provided to support the hollow fence post on concrete or other impenetrable surfaces. The stand may be a round frame having diametric cross bars attached to an upward-directed socket located near the center of the stand. The socket is configured for receiving the lower end of the hollow fence post therein, and retaining the fence post with a pin inserted through corresponding holes in the fence post and the socket. In this embodiment the sliding hammer and the stake are omitted and the stand may be weighted downward against the impenetrable surface with sandbags, for example.

In another alternate embodiment, the fixed jaw along the one side of the hollow post may be configured as an inside V-angle facing away from the one side of the hollow post and the elongated movable or pivoting jaw is configured as an elongated rod for clamping the flexible plastic safety fencing between the fixed inside V-angle and the pivoting rod jaws.

BRIEF DESCRIPTION OF THE DRAWINGS

FIG. 3A illustrates a detailed perspective drawing of the embodiment of the reusable fence post of FIG. 1, shown in an installed position;

FIG. 3B illustrates a cutaway view of the lower end of the hollow post, on the side opposite a first exterior side having an outside V-angle, showing a sliding hammer within the fence post and its attachment to a stake;

DETAILED DESCRIPTION OF THE INVENTION

Figure 1:
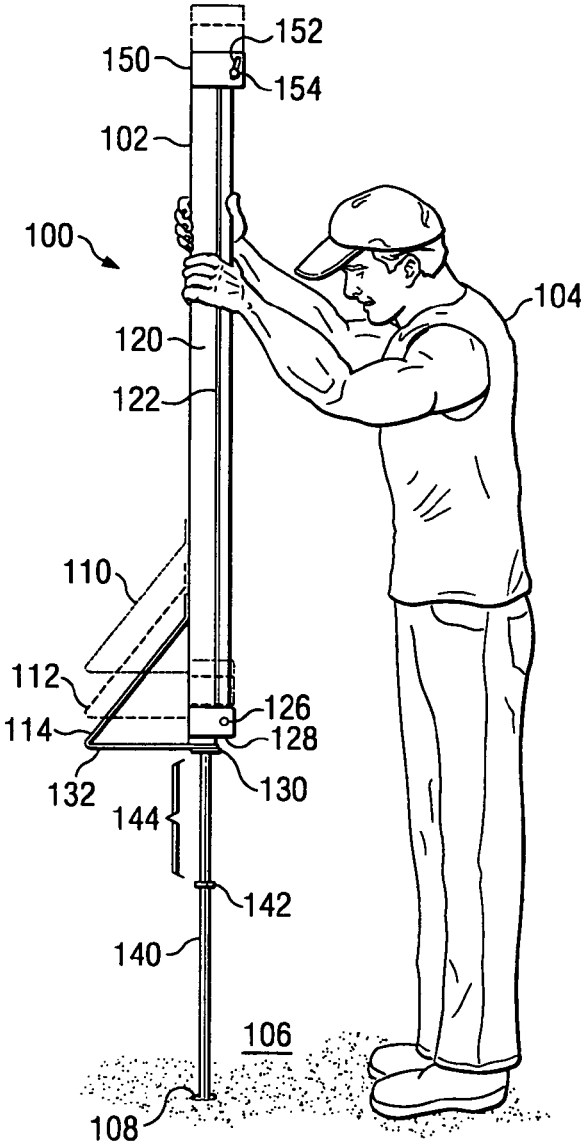
FIG. 1 illustrates the installation by a workman of one embodiment of a reusable fence post having a double angle iron jaw configuration for supporting a flexible plastic safety fencing according to the present disclosure, the fence post shown at the beginning of downward movement from an initial position.

FIG. 1 illustrates the installation, by a workman 104 standing on the ground 106, of one embodiment of a reusable fence post 100. The post is being installed in the ground 106 at a location 108. The reusable fence post 100 is shown at the beginning of downward movement from an initial position 110. The reusable fence post 100 includes a double angle iron jaw configuration (also called herein below a nested V-angle joint) for supporting a flexible plastic safety fencing according to the present disclosure. In this illustrative example, the reusable fence post 100 includes an elongated hollow post 102 having a predetermined length of approximately 4 feet, 6 inches, to accommodate a plastic fence width of four feet. The hollow post 102 is fabricated of a steel tube 120 having a wall thickness of 0.063 inch and a square cross section of 2"×2". The hollow post 102 is closed at the bottom end by a bottom cap 130, which includes a centrally positioned hole (not shown) to allow the passage of a stake 140. The stake 140 is connected at its top end to a sliding hammer disposed within the steel tubing 120. The sliding hammer will be described herein below with respect to FIG. 3B. A buttress brace 132, attached to the lower end of the hollow post 102, provides stability for the reusable fence post 100 when it is installed and is supporting the flexible plastic fencing. The buttress brace 132 forms an equilateral right triangle in cooperation with the lower end of the steel tube 120, which provides the vertical side of the right triangle. The buttress brace 132 is formed of flat, ¼ inch steel, two inches wide. The horizontal side of the right triangle of the buttress brace 132 extends past the right angle in FIG. 1 and is attached between the bottom end of the steel tube 120 and the bottom cap 130.

In FIG. 1, the phantom lines 110, 112 and the solid line 114 represent initial and following positions of the hollow post 102 as the workman 104 drops the hollow post 102 downward along the stake 140 and against a stop collar 142 that is attached to the stake 140. The stop collar 142 is located approximately midway between the bottom of the stake 140 and the top end (not shown, see FIG. 3B) of the stake 140. As the hollow post 102 is dropped forcefully down against the stop collar 142, the momentum of the hollow post is transferred to the stake 140, driving it into the ground 106. It may take several repetitions of this action to drive the stake 140 completely into the ground 106 until the stop collar 140 is near or substantially in contact with the ground 106. This method of driving the stake into the ground 106 is effective for most kinds of soil and surfaces having a hardness or density up to and including that of asphalt paving.

Continuing with FIG. 1, the hollow post 102 further includes an outside V-angle 122 clamping surface formed of a four foot, three inch length of 1"×1"×⅛" angle iron that is centered lengthwise and welded to a first exterior side of the steel tubing 120, with the inside angle (i.e., 90 degrees) of the angle iron facing the first exterior side of the steel tubing 120. The outside V-angle 122 of approximately 270 degrees forms a clamping surface that cooperates with an inside V-angle (approximately 90 degrees) provided by an elongated jaw member 124, also formed of 1"×1"×⅛" angle iron. The elongated jaw member 124, which is approximately four feet, four inches long, is attached to a lower end of the steel tubing 120 by a hinge pivot 126 that enables the elongated jaw member 124 to swing about the hinge pivot 126 from ward or toward the outside V-angle 122. The hinge pivot 126 is supported by a bracket 128 that is attached to the lower end of the steel tubing 120. In use, the elongated jaw member 124 is swung away from the first exterior side of the hollow post 102 to enable placing the plastic fencing material (not shown in FIG. 1, but see FIGS. 7 and 9) between the outside V-angle of the first exterior side of the hollow post 102 and the inside V-angle of the elongated jaw member 124. A top bracket 150, which is attached to the top end of the hollow post 102, includes a latch pin 152 that slides upward and downward in a pair of parallel slots 154 in opposite sides of the top bracket 150. The latch pin 152 moves upward to allow the elongated jaw member 124 to be placed against the plastic fencing and outside V-angle of the hollow post 102. The sliding pin then moves downward to secure the elongated jaw member against the plastic fencing and the outside V-angle of the first exterior side of the hollow post 102. The operation of the latching pin will be further described in conjunction with FIGS. 5A and 5B.

Figure 2:
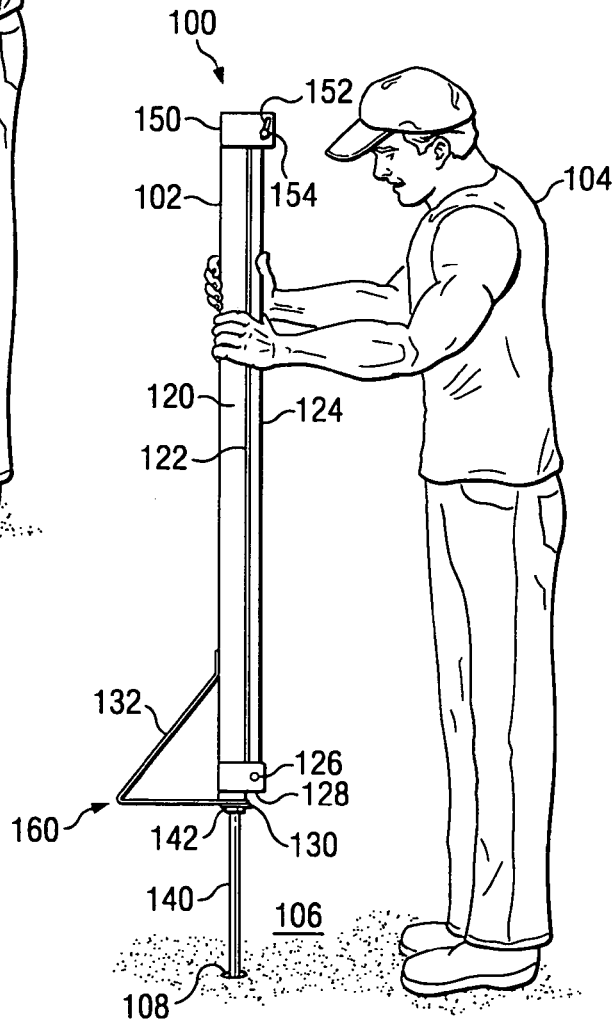
FIG. 2 illustrates the installation by a workman of the reusable fence post of FIG. 1 being rammed downward against a fixed collar around a stake within the fence post, driving the stake portion of the fence post into the ground.

FIG. 2 illustrates the installation by the workman 104 of the reusable fence post 100 of FIG. 1 being rammed downward against the stop collar 142, driving the stake 140 of the fence post 100 into a hole 108 in the ground 106. All reference numbers and structures are the same as shown in FIG. 1 except that the hollow post 102 is in a downwardmost position 160 with respect to the stop collar 142 as the stake 140 is driven into the ground 106.

FIG. 3A illustrates a detailed perspective drawing of the embodiment of the reusable fence post 100 of FIG. 1, shown in an installed position against the ground 106, with the buttress brace 132 positioned against the surface of the ground 106. Structures appearing in both FIGS. 1 and 3A that have the same reference numbers are identical and will not be further described. The reusable fence post 100 is shown with a middle portion of the steel tubing 120, the outside V-angle 122, and the inside V-angle (the elongated jaw member) 124 components cutaway. This view shows how the outside and inside V-angles 122, 124 are partially nested when the elongated jaw member 122 is positioned against the first exterior side of the hollow post 120. Thus, the outside and inside V-angles 122, 124 form a nested, V-angle joint. This nesting relationship is also formed when the plastic fencing material (not shown in FIG. 3A for clarity, but see FIG. 6A, reference number 172) is placed between the outside and inside V-angles 122, 124. The plastic fencing material, being approximately 20 mils thick, is relatively flexible and readily conforms to the shapes of the outside and inside V-angles 122, 124. The relatively sharp corners of the outside and inside V-angles 122, 124 force the plastic fencing into a like 90 degree angle all along the length of the V-angles 122, 124, which grips the plastic fencing tightly to prevent slippage of the plastic fencing in its lengthwise direction. The nested, V-angle joint also grips the plastic fencing across the full width of the plastic fencing, which also prevents slippage of the plastic fencing. It should also be pointed out that the sharpness of the 90 degree corners in the nested, V-angle joint are not knife-edge sharp and thus do not damage the plastic fencing material placed in and clamped in the nested, V-angle joint.

Continuing with FIG. 3A, there are shown several details of the latching mechanism disposed at the top end of the illustrative reusable fence post according to the present disclosure of FIG. 3A. The top bracket 150 is seen to also form a cap over the top end of the hollow post 102 to prevent the introduction of moisture or debris. The top bracket 150, formed of ¼ inch steel plate in the illustrative example, is shown as an inverted U-shaped component that extends beyond the first exterior side of the steel tubing 120 and the nested, V-angle, angle iron stack. Cut in a nearly vertical direction through the extension portions of the sides of the top bracket 150 are parallel slots 152. The parallel slots 152 are approximately 5/16 inch wide to permit free passage of a ¼ inch bolt 154 through the slots 152 of both extensions of the sides of the top bracket 150. The bolt 154, also called a sliding latch 154, moves upward in the slots 152 when a beveled end (see, e.g., FIG. 5A) of the elongated jaw member 124 is swung into contact with the sliding latch 154. As the uppermost tip of the elongated jaw member 124 passes under the sliding latch 154, the sliding latch 154 drops downward in the slots to capture the end of the elongated jaw member and hold it against the outside V-angle 122. In an alternate embodiment, a wire bail 156 may be attached to the ends of the sliding latch bolt 154 to aid in grasping and lifting (or pulling downward) the sliding latch bolt, to complete the latching of the elongated jaw member 124.

FIG. 3B illustrates a cutaway view of the lower end of the hollow post 102, on the side opposite the first exterior side having the outside V-angle 122, showing a sliding hammer 136 within the steel tubing 120 and the attachment of the sliding hammer 136 to the stake 140. Many of the structures of FIG. 3B appear in FIGS. 1 through 3 and bear the same reference numbers. The side opposite the first exterior side is shown partially cutaway to show a portion of the interior of the steel tubing 120 that forms the hollow post 102. Further, the buttress brace 132, which in this view would ordinarily be coming 'out of the page,' is not shown, except for an edge-wise view of the bottom portion of the buttress brace 132, so that the structures of interest in this figure may appear clearly. The buttress brace 132 appears at the bottom end of the hollow post 120, as shown in FIG. 1. Just below the buttress brace 132 is an end cap 130. Both the buttress brace 132 and the end cap 130 have a hole through its center, as indicated by the dotted lines 144 to permit the passage of the stake 140 therethrough. It will be appreciated that the buttress brace 132 extension effectively doubles the thickness of the bottom cap 130, forming a stronger abutment for driving the stake 140 into the ground 106.

The stake 140 may be formed of round No. 2 grade solid steel rod, ¾ inch in diameter, to a length of approximately three feet. Although it is not necessary to sharpen the lower end of the stake 140 to facilitate its entry into the surface of the earth or asphalt paving, in some applications sharpening the stake 140 may add to its utility. The sliding hammer 136 may be fabricated of 1-½"×1-½"×8 inches long square steel tubing, with end caps 138, 139 formed of 1-½"×1-½"×¼" steel plate. The end caps 138, 139 may be welded via welds 162 to the respective ends of the sliding hammer 136. A ¾" hole cut in each end cap enables the stake 140 to pass through the end caps 138, 139 and welded thereto. In an alternate construction, the holes in the end caps 138, 139 may be threaded to match corresponding threads on the stake 140. The stake may be secured to the sliding hammer 136 by a lock nut just below the end cap 138. Also welded via welds 162 to a midpoint of the stake 140 is a stop collar 142 formed of ¼ inch steel plate. The stop collar 142 may be cut round or square. In use, the slide hammer 136 slides freely within the hollow post 120 and the hollow post 120 is used as a ram to be thrust forcefully and repetitively as necessary against the stop collar 142 to install the reusable fence post 100 or against the lower end cap 138 to extract the reusable fence post 100.

Figure 4:
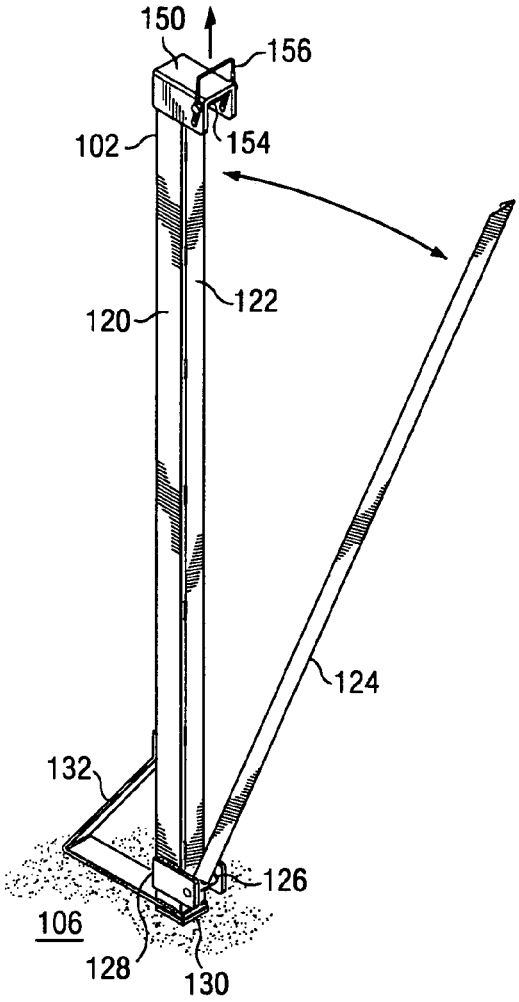
FIG. 4 illustrates the embodiment of FIG. 3 having a latch pin raised and an elongated jaw member swung away from the fence post in preparation for receiving a section of a flexible plastic safety fencing.

FIG. 4 illustrates the embodiment of FIG. 3A having a latch pin 154 held in a raised position and an elongated jaw member 124 swung away from the hollow fence post 102 in preparation for receiving a section of a flexible plastic safety fencing. All of the structures of FIG. 4 are the same as shown previously in FIGS. 1 through 3 and bear the same reference numbers.

Figure 5A:
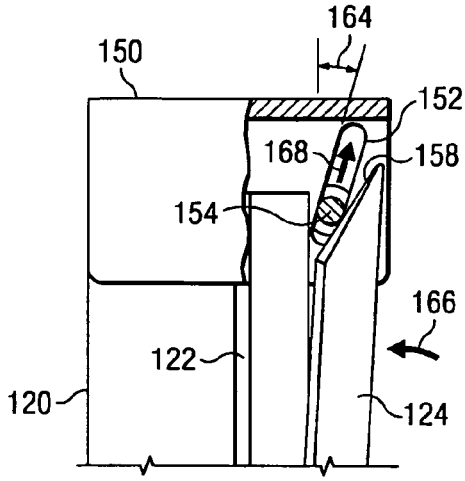
FIG. 5A illustrates a side view of the latch mechanism of the embodiment of FIGS. 1 through 4, just before the pivoting elongated jaw member becomes latched.

FIG. 5A illustrates a side view of the latch mechanism at the upper end of the reusable fence post 100 of the embodiment of FIGS. 1 through 4, just before the pivoting elongated jaw member 124 becomes latched when swinging it into position against the hollow post 102. The upper end of the elongated jaw member 124 is cut at an angle of approximately 30 degrees relative to the longitudinal axis of the elongated jaw member 124 to form a ramp angle or beveled edge 158. Further, the tip of the jaw member 124 is rounded to a radius of approximately 0.063 or greater. A latch pin 154, which may be a bolt retained in the pair of parallel slots 152 by a nut (not shown) threaded onto a threaded end of the bolt, passes through the parallel slots 152. As the jaw member 124 is swung (see the arrow 166) into contact with the latch pin 154, the latch pin 154 is caused to slide upward (see the arrow 168) along the ramp created by the beveled edge 158 of the jaw member 124 until the tip of the jaw member 124 slips under the latch pin 154. This process is facilitated by the slight angle 164 from the vertical, nominally approximately ten degrees, at which the slots 152 are cut into the sides of the top bracket 150. After the tip of the jaw member 124 passes under the latch pin 154, the latch pin 154 drops downward (see the arrow 170 in FIG. 5B) in the slots 152 due to the gravitational force exerted thereon, and toward the outside V-angle 122 to latch the jaw member against the outside V-angle 122 (See FIG. 5B). As will also be appreciated, the latching process may be accomplished very rapidly by simply swinging the jaw member toward the hollow post 102. The ramp angles provided for the upper end of the jaw member and the slots in the top bracket enable a rapid movement of the latch pin 154—first upward 168, then downward 170, within the slots 152 as the jaw member 124 is brought into contact with it.

Figure 5B:
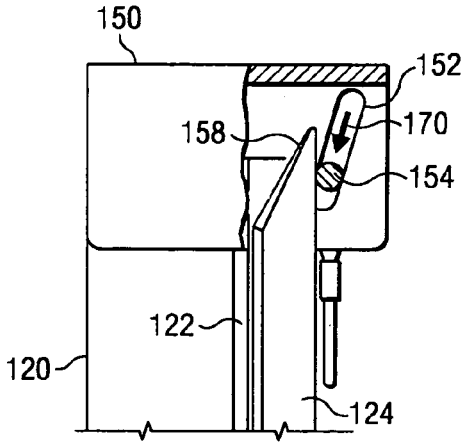
FIG. 5B illustrates a side view of the latch mechanism of the embodiment of FIGS. 1 through 4, just after the pivoting elongated jaw member is latched into a clamping position against the fixed jaw member on the first exterior side of the hollow post.

FIG. 5B illustrates a side view of the latch mechanism of the embodiment of FIGS. 1 through 4, just after the pivoting elongated jaw member 124 is latched into a clamping position against the fixed, outside V-angle on the first exterior side of the hollow post. All of the structures of FIG. 5B are the same as in FIG. 5A and bear the same reference numbers.

Figure 6A:
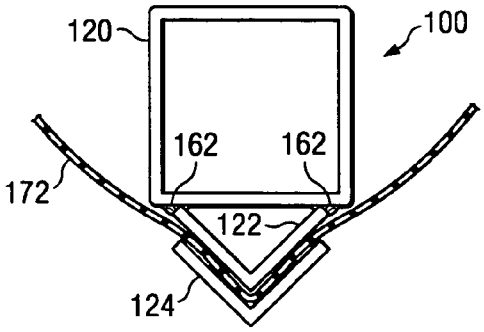
FIG. 6A illustrates a sectional view from the top of the reusable fence post of FIG. 3 showing the relationship of the flexible plastic safety fencing clamped between the movable and fixed jaws of the reusable fence post according to the present disclosure.

FIG. 6A illustrates a sectional view from the top of the reusable fence post of FIG. 3 showing the relationship of the flexible plastic safety fencing 172 clamped between the movable 124 and fixed 122 jaw members of the reusable fence post 100 according to the present disclosure. The structures shown in FIG. 6A are the same as shown in FIG. 3 except for the flexible plastic fencing 172 and bear the same reference numbers. The flexible plastic fencing material 172 may be a flexible, plastic fencing approximately 20 mils thick that is typically supplied in 50 foot or 100 foot rolls and is four feet wide. This fencing material, in one typical product supplied by Tenax Corporation, Baltimore, Md. 21205, is formed of high density polyethylene (HDPE), which provides a strong yet lightweight fencing that is well suited for use in a variety of applications, particularly as a safety barrier around construction sites and excavations. Its light weight and flexibility makes it easy to handle by work crews. As may be seen in the figure, the fencing material 172 is clamped between the outside V-angle 122 and the inside V-angle 124, wherein the V-angle joint formed thereby securely grips the fencing material 172 such that it cannot slip along its length (to the left or right in the figure) or across its width (into or out of the page in the figure). This feature, not previously known to be available, provides greatly increased utility in supporting a flexible plastic safety fence 172 of the type that is commonly used to provide a safety barrier surrounding a construction or excavation site.

Figure 6B:
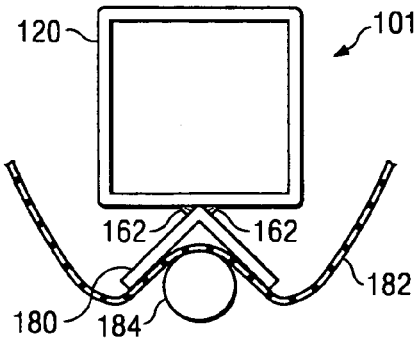
FIG. 6B illustrates a sectional view from the top of an alternate embodiment of the reusable fence post of FIG. 3 showing the relationship of the flexible plastic safety fencing clamped between the movable and fixed jaws of the reusable fence post according to the present disclosure.

FIG. 6B illustrates a sectional view from the top of an alternate embodiment 101 of the reusable fence post 100 of FIG. 3 showing the relationship of the flexible plastic safety fencing 172 clamped between the movable 184 and fixed 180 jaw members of the reusable fence post 101 according to the present disclosure. In this embodiment, the fixed jaw member 180, formed of the same size angle iron as the outside V-angle 122 that is used in the reusable fence post 100 of FIG. 3, is rotated by 180 degrees about its longitudinal axis such that it orients the inside V-angle to face the first exterior side of the hollow post 120. The elongated jaw member 184 is formed from a solid no. 2 grade steel rod ½ inch in diameter. The operation is the same as in the reusable fence post 100 described herein above. The latching action is essentially the same because the same latching mechanism is used and the elongated jaw member 184 is beveled in the same manner and at the same angle as in the previous embodiment. The flexible plastic fencing 182 is clamped with nearly the same resistance to slippage as the previously described embodiment, but is a little less effective because the radius of the cross section of the elongated jaw member 184 is substantially larger than the radius of the inside corner of the cross section of the inside V-angle 180 (the fixed jaw).

Figure 7:
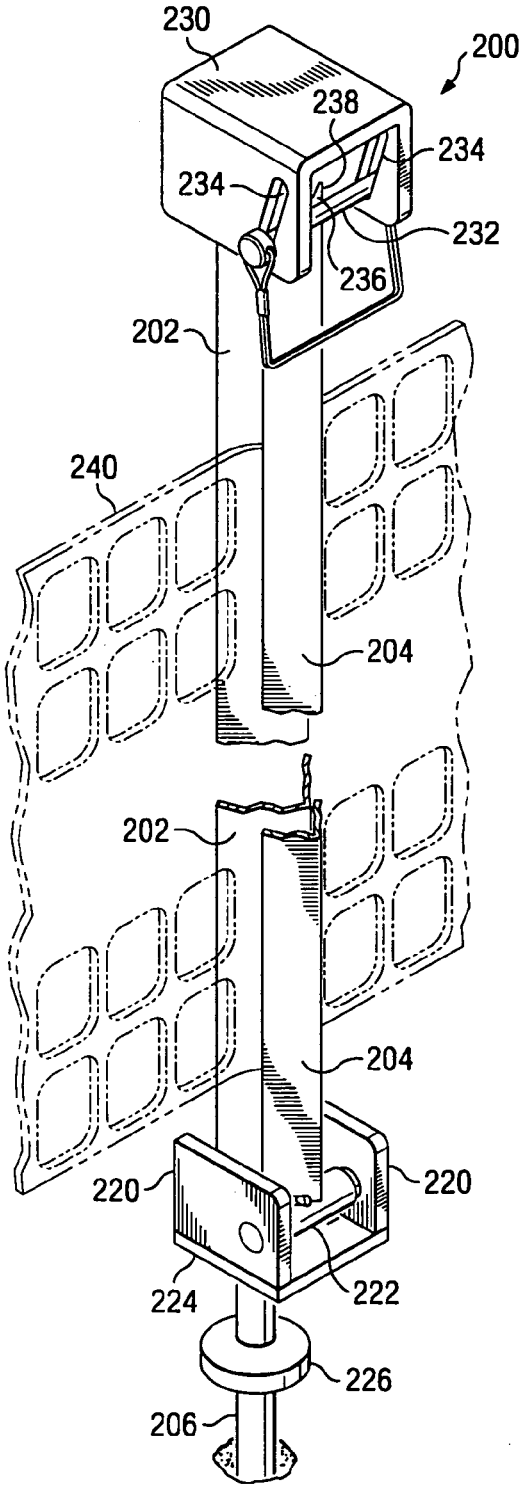
FIG. 7 illustrates an alternate, low-cost embodiment of a reusable fence post that eliminates the hollow tube body of the reusable fence post according to the present disclosure.

FIG. 7 illustrates an alternate, low-cost embodiment of a reusable fence post 200 that eliminates the hollow body of the reusable fence post according to the present disclosure. A first length of angle iron, outside V-angle 202 serves as a post. A second length of angle iron, which forms the elongated jaw member and serves as an inside V-angle 204, is hinged to the lower end of the outside V-angle 202 by a hinge 222 that is supported by a hinge bracket 220 welded to the lower end of the inside V-angle 202. A bottom cap 224 is attached to the bottom end of the outside V-angle (post) 202. The outside V-angle 202 is configured to nest within the inside V-angle 204 (the elongated jaw member) when the inside V-angle 204 is swung to a latched position against the flexible plastic fencing 240 held between the outside V-angle 202 and the inside V-angle 204. A latch bracket 230, which may be shaped like an inverted U, is attached to the upper end of the outside V-angle 202. The latching mechanism is constructed similarly to the latching mechanism illustrated in FIGS. 5A and 5B and operates in the same way.

The latch bracket 230 of FIG. 7 supports the latch pin 232 in a pair of parallel slots 234 cut into extensions of the side portions of the latch bracket 230. A latch pin 232, which may be a bolt retained in the pair of parallel slots 234 by a nut threaded onto one end of the bolt, passes through the parallel slots 234. The upper end of the elongated jaw member 204 is cut at an angle of approximately 30 degrees relative to the longitudinal axis of the elongated jaw member 204 to form a ramp angle or beveled edge 236. Further, the tip 238 of the elongated jaw member 204 is rounded to a radius of approximately 0.063 inches or greater. A latch pin 232, which may be a bolt retained in the pair of parallel slots 234 by a nut (not shown) threaded onto a threaded end of the bolt, passes through the parallel slots 234. As the elongated jaw member 204 is brought into contact with the latch pin 232, the latch pin 232 is caused to slide upward in the slots 234 and along the ramp created by the beveled edge 236 of the elongated jaw member 204 until the tip 238 of the elongated jaw member 204 slips under the latch pin 232. This process is facilitated by the slight angle from the vertical, nominally approximately ten degrees, at which the slots 234 are cut into the sides of the latch bracket 230. After the tip 238 of the elongated jaw member 204 passes under the latch pin 232, the latch pin 232 drops downward in the slots 234 due to the gravitational force exerted thereon, and toward the outside V-angle 202 to latch the elongated jaw member 204 having the inside V-angle against the outside V-angle 202. As will also be appreciated, the latching process may be accomplished very rapidly by simply swinging the elongated jaw member 204 toward the post formed by the outside V-angle 202. The ramp angles provided for the upper end of the elongated jaw member 204 and the slots 234 in the latch bracket 230 enable a rapid movement of the latch pin 232 first upward then downward within the slots 234 as the elongated jaw member 204 is brought into contact with it.

Continuing with FIG. 7, the flexible plastic fencing 240 is shown clamped within and between the "jaws" of the reusable fence post 200, the outside V-angle 202 (the post) and the inside V-angle 204 (the elongated jaw member or the pivoting arm or jaw member). The plastic fencing 240, as shown previously in the view of FIG. 6A, is seen to be folded or bent around the 90 degree angle within the nested V-angles. The combination of the tight grip provided all across the width of the plastic fencing 240 and the 90 degree bend in the fencing material ensures the flexible plastic fencing 240 is held without slippage either lengthwise or crosswise. At the lower end of the outside V-angle 202 (i.e., the post) and disposed within the V-angle is the stake 206 that is hammered into the ground by repetitive downward thrusts of the post 202 against the stop collar 226. The construction of the mechanism for hammering the stake 206 will be described in conjunction with FIG. 8.

Figure 8:
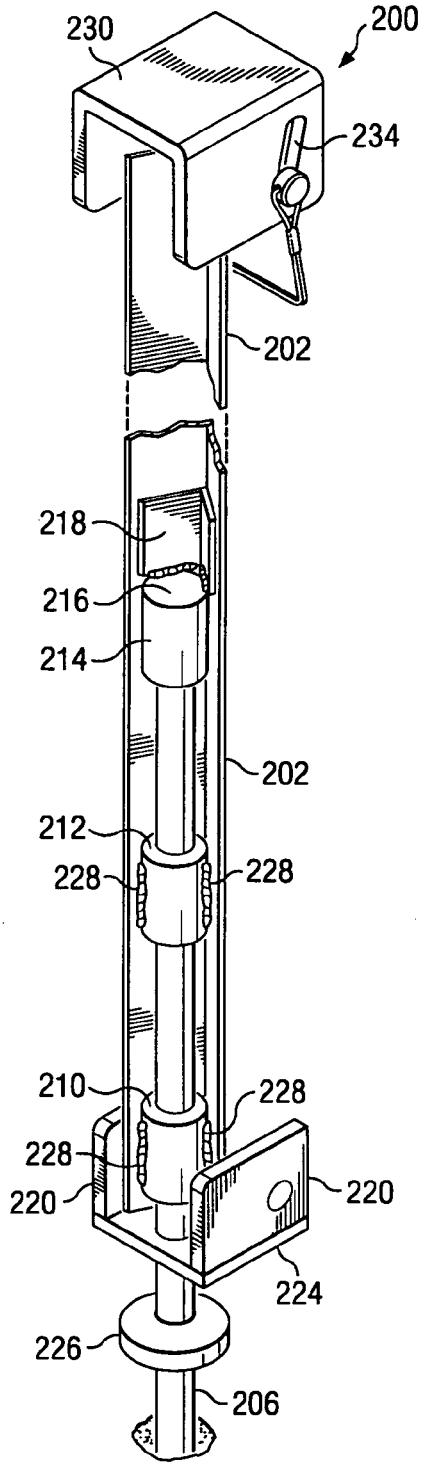
FIG. 8 illustrates a view of an opposite side of the embodiment of the reusable fence post shown in FIG. 7.

FIG. 8 illustrates a view of a portion of the opposite side of the embodiment of the reusable fence post 200 shown in FIG. 7. In FIG. 8, the outside V-angle 202 is shown with the stake 206 disposed within three pipe sections 210, 212, and 214. Each pipe section 210, 212 is attached to the inside V of the outside V-angle 202 by the welds 228. The uppermost pipe section 214 is welded to the stake 206 and a small section 218 of angle iron that is disposed against the inside angle of the outside V-angle 202. The small section 218 of angle iron slides against the inside surface of the outside V-angle 202 to stabilize the up and down movement of the stake 206 during installation or extraction of the stake into or from the ground. The stake 206, a round, solid steel rod ¾ inch in diameter formed of no. 2 grade steel, includes a stop collar 226 attached to a midpoint of the stake 206. The stake 206 is hammered into the ground or extracted from the ground by forcefully thrusting respectively downward against the stop collar 226 or upward against the underside of the top cap 216, in the same manner as the reusable fence post 100 illustrated in FIGS. 1 and 2. The stake 206 slides freely within the pipe sections 210 and 212. The top cap 216 may be a metal plate welded across the upper end of the pipe section 214 and reinforced by the small section of angle iron welded to the top cap 216 as shown in FIG. 8.

Figure 9:
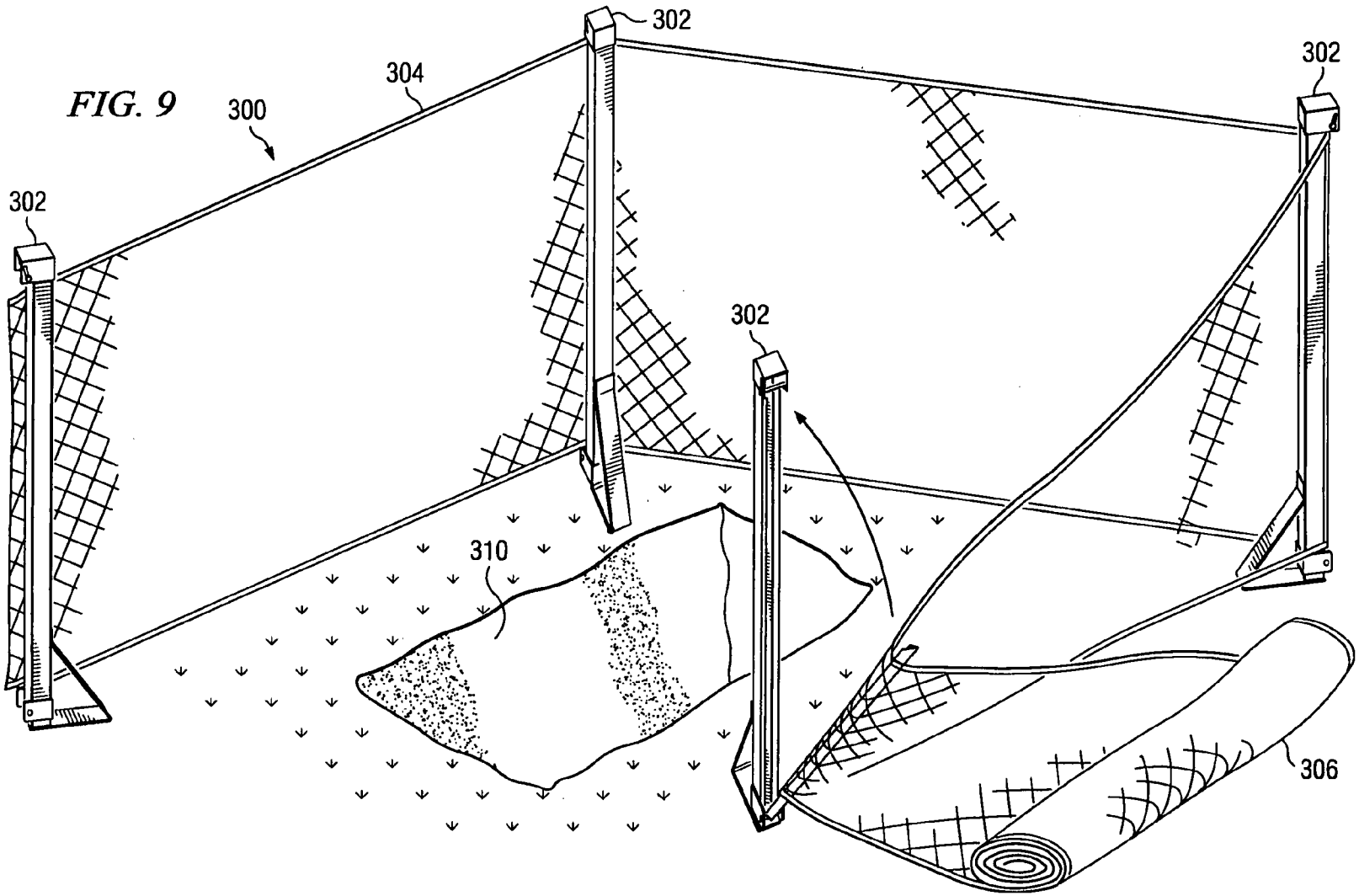
FIG. 9 illustrates an excavation being surrounded by a plastic safety fence supported by the reusable fence posts according to the present disclosure.

FIG. 9 illustrates an installation 300 of a plastic fence around an excavation 310 using four reusable fence posts 100 according to the present disclosure. In the figure, the four reusable fence posts, identified in the figure with the reference number 302, are set up to support a length of the flexible plastic fencing 304 from a storage roll 306. The fencing 304 is already attached to three of the reusable fence posts 302. The reusable fence post 302 in the foreground, the fourth (and last) one from the starting point at the free, initial end of the plastic fencing 304), is shown with its elongated jaw member in position to be swung toward the post to clamp the plastic fencing to the post. As the fencing is secured to the foreground post 302, the storage roll 306 of fencing material may be carried around the near side corner at the fourth post and secured to the last (and first) post, overlapping the initial end of the fencing 304. The fencing material may be cut to length or left uncut and perhaps tied to the post at that corner of the fence installation 300.

Figure 10:
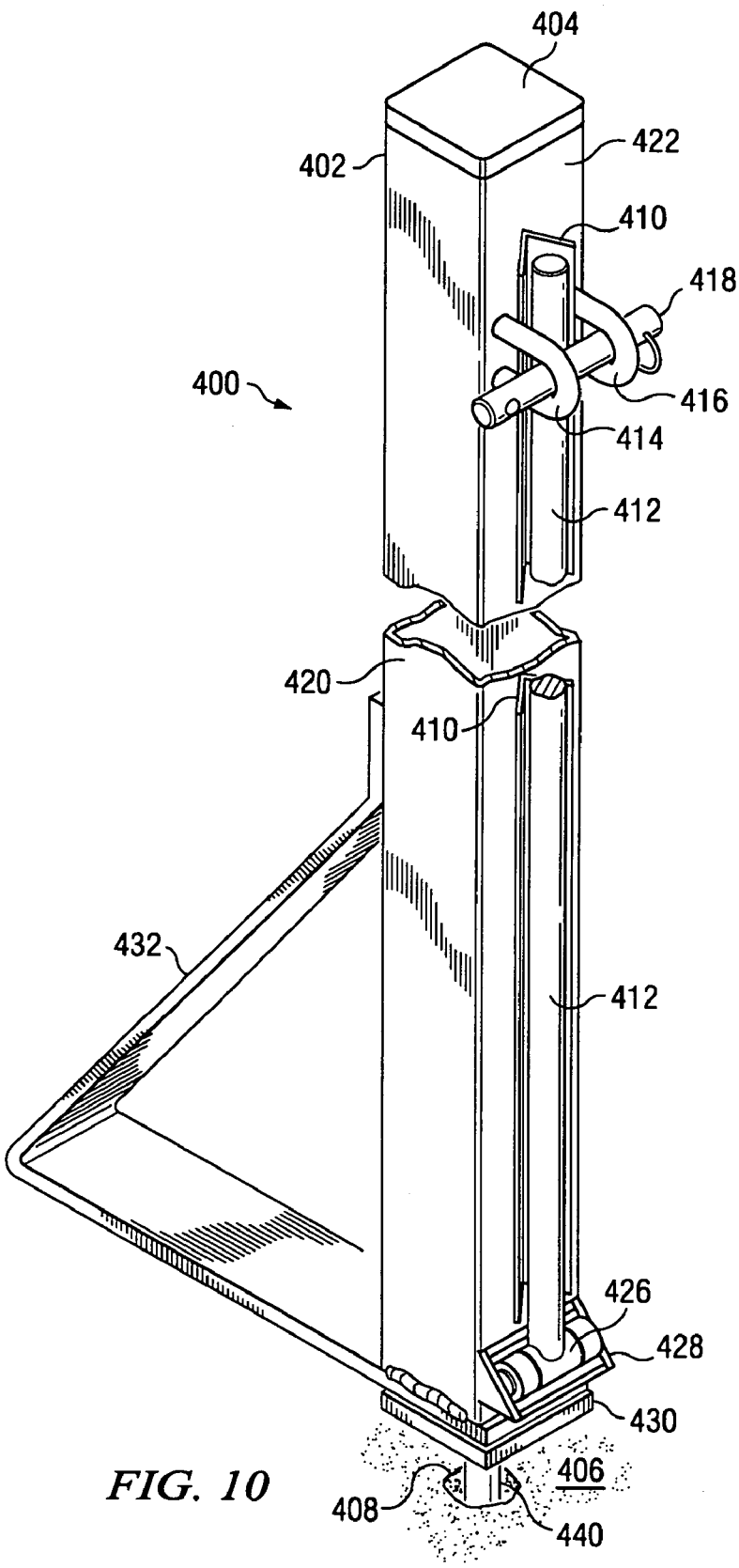
FIG. 10 illustrates an alternate embodiment of the reusable fence post of FIG. 3A having an angle-and-rod jaw configuration and corresponding hinge and latching devices.

FIG. 10 illustrates an alternate embodiment 400 of the reusable fence post of FIG. 3A but having instead an angle-and-rod jaw configuration (see also FIG. 6B supra) and corresponding hinge and latching devices. The reusable fence post 400 of FIG. 10 is shown in an installed position with its buttress brace 432 against the ground 406. In this illustrative example, the reusable fence post 400 includes an elongated hollow post 402 having a predetermined length of approximately 4 feet, 6 inches, to accommodate a plastic fence width of four feet. The hollow post 402 is fabricated of a steel tube 420 having a wall thickness of 0.063 inch and a square cross section of 2"×2". The hollow post 402 is closed at the bottom end by a bottom cap 430, which includes a centrally positioned hole (not shown) to allow the passage of a stake 440. The stake 440 is connected at its top end to a sliding hammer disposed within the steel tubing 420. The construction and operation of the sliding hammer is the same as described in FIG. 3B herein above. The sliding hammer causes the stake 440 to be driven into or extracted from the ground 406 at the location 408.

The reusable fence post 400 is shown with a middle portion of the steel tubing 420, the inside V-angle 410, and the solid round rod (the elongated jaw member) 412 components cut away. This view shows how the inside V-angle 410 and the round rod 412 are partially nested when the round rod 412, i.e., the elongated jaw member 412, is positioned against the first exterior side of the hollow post 420. Thus, the inside V-angle 410 and the round rod 412 form a nested joint. This nesting relationship is also formed when the plastic fencing material (not shown in FIG. 10 for clarity, but see FIG. 6B, reference number 182) is placed between the inside V-angle 410 and the round rod 412. The plastic fencing material, being approximately 20 mils thick, is relatively flexible and substantially conforms to the shapes of the inside V-angle 410 and the round rod 412. The corner of the inside V-angle 410 and the round rod 412 force the plastic fencing into approximately a right angle all along the length of the inside V-angle 410 and the round rod 412, which grips the plastic fencing tightly to prevent movement of the plastic fencing in its lengthwise direction. The nested joint also grips the plastic fencing across the full width of the plastic fencing.

Continuing with FIG. 10, there are shown several details of the latching mechanism disposed near the upper end of the illustrative reusable fence post 400 according to the present disclosure. First and second U-shaped loops 414, 416 are attached to the first exterior side 422 of the hollow post 420, one on either side of the inside V-angle 410 just below the upper end of the inside V-angle 410. The U-shaped loops 414, 416 are vertically oriented and parallel to each other such that a latch pin 418, when inserted through both loops, is disposed laterally across the round rod 412 to secure it in place, but also nested within the V of the inside V-angle 410. Further shown in FIG. 10 is a hinge 426, supported in a hinge bracket 428 attached to the lower end of the first exterior side 422 of the hollow body 420, which permits the round rod 412, functioning as the elongated jaw member to pivot fromward or toward the inside V-angle 410 that is also attached to the first exterior side 422 of the hollow body 420.

Figure 11:
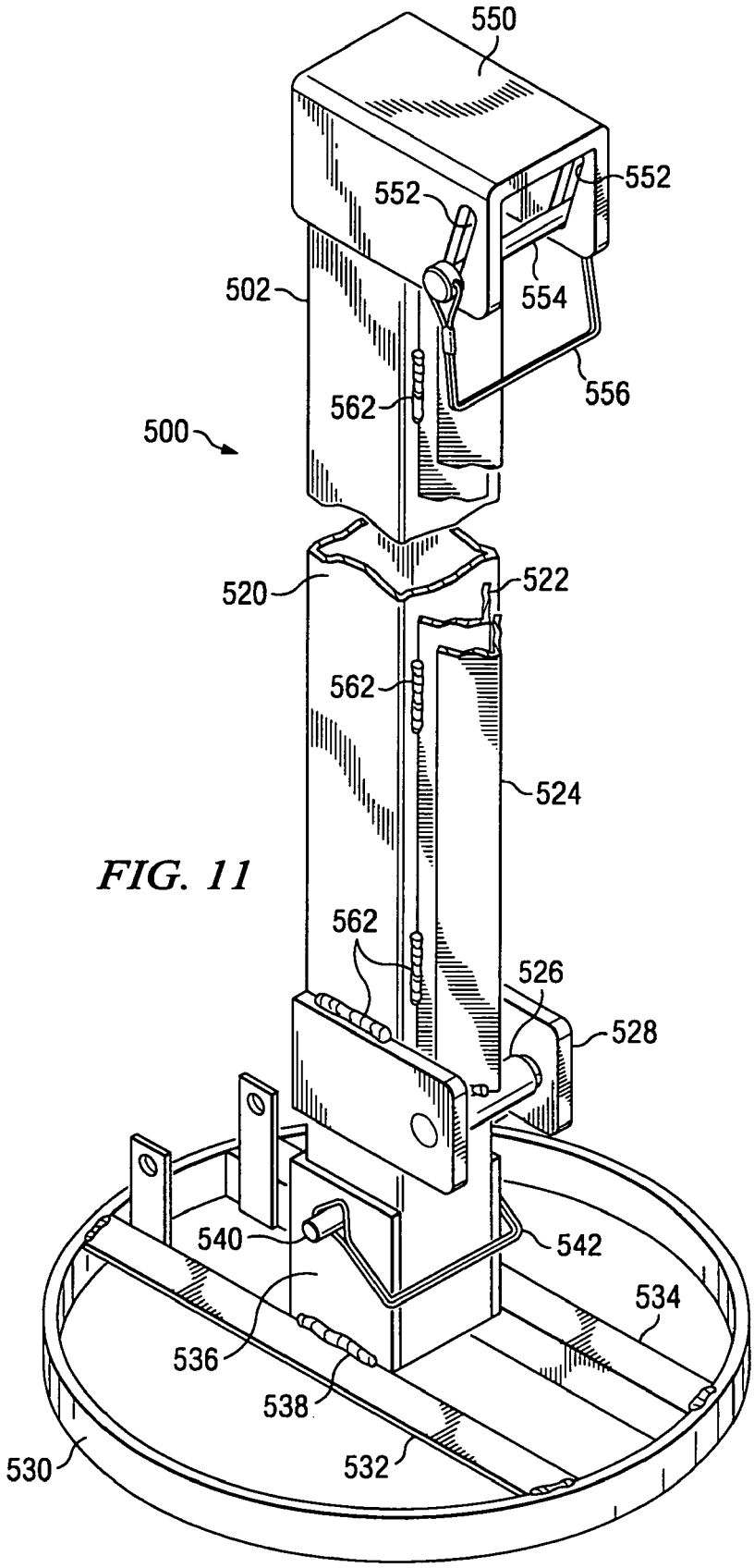
FIG. 11 illustrates an alternate embodiment of the reusable fence post of FIG. 3A having a planar base for supporting the reusable fence post upon a concrete or other impenetrable surface.

FIG. 11 illustrates an alternate embodiment of the reusable fence post of FIG. 3A having a planar base for supporting the reusable fence post 500 upon a concrete or other impenetrable surface. In this illustrative example, the reusable fence post 500 includes an elongated hollow post 502 having a predetermined length of approximately 4 feet, 6 inches, to accommodate a plastic fence width of four feet. The hollow post 502 is fabricated of a steel tube 520 having a wall thickness of 0.063 inch and a square cross section of 2"×2". The hollow post 502 further includes an outside V-angle 522 clamping surface formed of a four foot, three inch length of 1"×1"×⅛" angle iron that is centered lengthwise and welded to a first exterior side of the steel tubing 520, with the inside angle (i.e., 90 degrees) of the angle iron facing the first exterior side of the steel tubing 520. The outside V-angle 522 of approximately 270 degrees forms a clamping surface that cooperates with an inside V-angle (approximately 90 degrees) provided by an elongated jaw member 524, also formed of 1" ×1"×⅛" angle iron. The elongated jaw member 524, which is approximately four feet, four inches long, is attached to a lower end of the steel tubing 520 by a hinge 526 that enables the elongated jaw member 524 to swing about the pivot 526 fromward or toward the outside V-angle 522. The hinge 526 is supported by a bracket 528 that is attached to the lower end of the steel tubing 520. In use, the elongated jaw member 524 is swung away from the first exterior side of the hollow post 502 to enable placing the plastic fencing material (not shown in FIG. 11, but see FIGS. 7 and 9) between the outside V-angle 522 of the first exterior side of the hollow post 502 and the inside V-angle of the elongated jaw member 524. A top bracket 550, which is attached to the top end of the hollow post 502, includes a latch pin 552 that slides upward and downward in a pair of parallel slots 554 in opposite sides of the top bracket 550. The latch pin 552 moves upward to allow the elongated jaw member 524 to be placed against the plastic fencing and outside V-angle 522 of the hollow post 502. The sliding pin 554 then moves downward to secure the elongated jaw member 524 against the plastic fencing and the outside V-angle 522 of the first exterior side of the hollow post 502. The operation of the latching pin 554 has been further described in conjunction with FIGS. 5A and 5B for the embodiment of FIGS. 1 through 4.

The reusable fence post 500 is shown with a middle portion of the steel tubing 520, the outside V-angle 522, and the inside V-angle (the elongated jaw member) 524 components cut away. This view shows how the outside and inside V-angles 522, 524 are partially nested when the elongated jaw member 522 is positioned against the first exterior side of the hollow post 520. Thus, the outside and inside V-angles 522, 524 form a nested, V-angle joint. This nesting relationship is also formed when the plastic fencing material (not shown in FIG. 11 for clarity, but see FIG. 6A, reference number 172) is placed between the outside and inside V-angles 522, 524. The plastic fencing material, being approximately 20 mils thick, is relatively flexible and readily conforms to the shapes of the outside and inside V-angles 522, 524. The relatively sharp corners of the outside and inside V-angles 522, 524 force the plastic fencing into a like 90 degree angle all along the length of the V-angles 522, 524, which grips the plastic fencing tightly to prevent movement of the plastic fencing in its lengthwise direction. The nested, V-angle joint also grips the plastic fencing across the full width of the plastic fencing. It should also be pointed out that the sharpness of the 90 degree corner in the nested, V-angle joint is not knife-edge sharp and thus does not damage the plastic fencing material placed in and clamped in the nested, V-angle joint.

Continuing with FIG. 11, there are shown several details of the latching mechanism disposed at the top end of the illustrative reusable fence post according to the present disclosure. The top bracket 550 is seen to also form a cap over the top end of the hollow post 502 to prevent the introduction of moisture or debris. The top bracket 550, formed of ¼ inch steel plate in the illustrative example, is shown as an inverted U-shaped component that extends beyond the first exterior side of the steel tubing 520 and the nested, V-angle, angle iron stack. Cut in a nearly vertical direction through the extension portions of the sides of the top bracket 550 are parallel slots 552. The parallel slots 552 are approximately 5/16 inch wide to permit free passage of a ¼ inch bolt 554 through the slots 552 of both extensions of the sides of the top bracket 550. The bolt 554, also called a sliding latch 554, moves upward in the slots 552 when a beveled end (see, e.g., FIG. 5A) of the elongated jaw member 524 is swung into contact with the sliding latch 554. As the uppermost tip of the elongated jaw member 524 passes under the sliding latch 554, the sliding latch 554 drops downward in the slots to capture the end of the elongated jaw member and hold it against the outside V-angle 522. In an alternate embodiment, a wire bail 556 may be attached to the ends of the sliding latch bolt 554 to aid in grasping and lifting, or pulling downward, the sliding latch bolt to complete the latching of the elongated jaw member 524.

The base 530 for the reusable fence post 500 of FIG. 11 is formed of 1-½ inch×¼ inch flat steel rolled into a hoop approximately 24 inches in diameter. First and second parallel cross members 532, 534, spaced approximately four inches apart, are welded to the inside perimeter of the base 530 and extend across the diameter of the hoop that forms the base 530. The combination of the hoop and the cross members form a planar base 530. In some embodiments only a single cross member may be required. A boxed receptacle 536 is welded to the first and second parallel cross members in the center portion of the base 530. The boxed receptacle 536 is dimensioned to receive the lower end of the steel tube 520 of the hollow post 502 therein. The steel tube 520 is secured by a pin 540 passing laterally through the receptacle 536 and the steel tube of the hollow post 502 to retain the hollow post 502 in the base 530. When placed on a flat surface of the ground, that is otherwise impenetrable by a stake, the base 530 may be weighted by one or more sandbags. In a modification, the planar base 530, formed as a hoop approximately 24 inches in diameter, may be replaced by first and second straight braces formed of 2"×2" angle iron (not shown), the first brace welded at right angles and proximate a midpoint thereof to first ends of the first and second cross members 532, 534, and the second brace welded at right angles and proximate a midpoint thereof to second, opposite ends of the first and second cross members 532, 534. As thus attached, the first and second braces of the angle iron are substantially parallel to one another. The combination of the substantially parallel braces and the cross member(s) resemble a letter "H" in a plan view. Further, the first and second braces of the angle iron may include holes disposed near the ends of each first and second brace of angle iron for tying the planar base to stakes or tie-points (neither is shown in the drawing) installed in the surface of the ground. This modification to the base 530 enables improved stability on some kinds of surfaces upon which the reusable fence posts of the present disclosure may be used.

While the invention has been shown in only several of its forms, it is not thus limited but is susceptible to various changes and modifications without departing from the spirit thereof.

What is claimed is:

1. A reusable fence post for supporting roll-up safety fencing having a predetermined width around an excavation or construction site, comprising:

an elongated hollow post having a first longitudinal axis, a first predetermined length, a first exterior side having an outside V-angle clamping surface disposed therealong and a predetermined interior cross section, and further closed at a bottom end except for an opening of predetermined shape in the bottom end centered along the first longitudinal axis;

a stake extending downward a second predetermined length along a second longitudinal axis from and attached to a lower end of a sliding hammer, wherein the hammer slides freely within the predetermined length of the hollow post along the first longitudinal axis and wherein the stake extends downward through the opening in and outward from the bottom end of the hollow post and wherein a lower stop collar is secured orthogonal to and around the outward extending portion of the stake approximately bisecting the second predetermined length of the stake; and an elongated jaw member, having an inside V-angle clamping surface facing the outside V-angle clamping surface disposed along the first exterior side of the hollow fence post, the elongated jaw member being longer than the width of the safety fencing by a predetermined increment and hinged at the lower end to the hollow post near the bottom end of the hollow post on the first exterior side of the hollow post, wherein the upper end of the elongated jaw member swings in an arc to close the elongated jaw against the safety fencing held between the inside and outside V-angle clamping surfaces, thereby clamping the safety fencing therebetween.

2. The fence post of claim 1, wherein the safety fencing is held between the inside and outside V-angle clamping surfaces such that the outside V-angle clamping surface of the first exterior side of the hollow post is nested partially within the inside V-angle clamping surface of the elongated jaw member while clamping the safety fencing therebetween.

3. The fence post of claim 2, further comprising:

a latch disposed near the upper end of the hollow post for retaining the upper end of the elongated jaw member against the first exterior side of the hollow post in a closed jaw configuration after the safety fencing is placed between the outside V-angle of the hollow post and the inside V-angle of the elongated jaw member wherein the length of the safety fencing is positioned substantially at a right angle to the hollow post.

4. The fence post of claim 3, wherein the fence post is installable on-site in earth or aggregate or thin asphalt paving surfaces without tools.

5. The fence post of claim 3, wherein the fence post is installable on-site in earth or aggregate or asphalt surfaces by one person without tools.

6. The fence post of claim 3, wherein the latch comprises a pivoting bail secured to the top end of the hollow post and disposed for looping over the upper end of the elongated jaw member.

7. The fence post of claim 3, wherein the latch comprises:

slotted extensions of first and second opposite sides of the hollow post adjoining the first exterior side of the hollow post and disposed at the top of the hollow post such that the slotted extensions are at least approximately parallel and opposite one another and extend past the first exterior side of the hollow post at the top of the hollow post, wherein the slots in each extension are disposed at a first ramp angle from the vertical and extending upward and away from the hollow post;

a sliding pin, laterally and freely passing through both slots and retained therein such that the sliding pin may be moved upward or downward in the slots, moving respectively upward and away from the first exterior side of the hollow post or downward and toward the first exterior side of the hollow post when the elongated jaw member, having a second ramp angle cut downward across its upper end on the side of the elongated jaw member facing the first exterior side of the hollow post wherein the second ramp angle is greater than the first ramp angle, is brought into contact with the sliding pin causing the sliding pin to move upward within the slots and along the second ramp angle of the elongated jaw member until the upper end of the elongated jaw member passes under the sliding pin allowing the sliding pin to then move downward along the outside of the elongated jaw member and toward the first exterior side of the hollow post and, the sliding pin being retained in position by gravity thereby holding the elongated jaw member against the first exterior side of the hollow post to retain the elongated jaw member in position to clamp the safety fencing to the hollow post.

8. The fence post of claim 7, wherein the sliding pin includes a wire bail attached at each end of the sliding pin for use as a handle to lift the sliding pin while latching the elongated jaw member into position.

9. The fence post of claim 7, wherein the sliding pin is a bolt having a threaded end and retained in position through both slots by at least a nut installed on the threaded end of the bolt.

10. The fence post of claim 2, wherein the clamping surface of the elongated jaw member is offset from contact with the clamping surface of the first exterior side of the hollow fence post at the hinged end thereof by an amount approximately equal to a thickness of the safety fencing.

11. The fence post of claim 2, wherein the predetermined increment by which the length of the elongated jaw member exceeds the width of the safety fencing is at least approximately one inch.

12. The fence post of claim 2, wherein the upper end of the elongated jaw member is configured to be received in a latching relationship with a latching device disposed on the top end of the hollow post.

13. The fence post of claim 2, wherein the top end of the hollow post is configured with a latching device for receiving the upper end of the elongated jaw member in a latching relationship therewith.

14. The fence post of claim 1, wherein the hollow post is fabricated of metal tubing having a predetermined cross section selected from the group consisting of rectangular, triangular, circular, and elliptical.

15. The fence post of claim 14, wherein the hollow post is formed of 2 inch×2 inch rectangular steel tubing having a nominal wall thickness of 0.063 inches.

16. The fence post of claim 1, wherein the hollow fence post has a first predetermined length that exceeds the width of the safety fencing by at least approximately two inches.

17. The fence post of claim 1, wherein the opening in the closed bottom end of the elongated hollow post is shaped approximately like the cross section of the stake and sized to permit unimpeded passage of the stake but not the slide hammer or the lower stop collar when the hollow post is used as a ram to drive the stake into the earth by forceful, repetitive downward movement of the hollow post against the lower stop collar or extract the stake from the earth by forceful, repetitive upward movement of the hollow post against the slide hammer.

18. The fence post of claim 17, wherein the opening is disposed in an end cap attached to the bottom end of the hollow post such that the end cap can withstand upward or downward pounding forces of at least 160 pounds.

19. The fence post of claim 1, wherein the first exterior side of the hollow fence post is configured to have an outwardly triangular profile extending along substantially all the first predetermined length to provide the outside V-angle clamping surface, except within approximately three inches of both the top end and the bottom end of the hollow fence post.

20. The fence post of claim 1, wherein the top end of the hollow fence post may include a cap to exclude moisture and debris.

21. The fence post of claim 1, wherein the hollow fence post includes a buttress brace disposed at the lower end of the hollow fence post on the side opposite the first exterior side of the fence post.

22. The fence post of claim 1, wherein the stake comprises a metal rod having a diameter of at least 0.50 inches and a length of at least one-half as long as the width of the safety fencing.

23. The fence post of claim 1, wherein the stake includes a sharpened tip at its lowest end for positioning the hollow fence post and penetrating the earth surface during installation of the post.

24. The fence post of claim 1, wherein the slide hammer comprises a metal body having an exterior cross section shaped like and slightly smaller than the interior cross section of the hollow post such that the slide hammer is disposed within and slides freely within the predetermined length of the hollow post along the first longitudinal axis.

25. The fence post of claim 1, wherein the first longitudinal axis and the second longitudinal axis substantially coincide.

26. A reusable fence post for supporting roll-up safety fencing around an excavation or construction site, comprising:

an elongated hollow post having a first longitudinal axis, a first predetermined length, a first exterior side and a predetermined interior cross section, closed at a top end and closed at a bottom end except for an opening of predetermined shape in the bottom end centered along the first longitudinal axis;

a stake extending downward a second predetermined length along a second longitudinal axis from a slide hammer, wherein the slide hammer slides freely within the predetermined length of the hollow post along the first longitudinal axis and wherein the stake extends downward and outward through the opening in the bottom end of the hollow post and wherein a lower stop plate is secured orthogonal to and around the outward extending portion of the stake approximately bisecting the second predetermined length of the stake;

an elongated jaw member, of a length from a lower end to an upper end approximately six inches longer than a width of the safety fencing but not more than the first predetermined length of the hollow post, hinged at the lower end to the hollow post near the bottom end of the hollow post on the first exterior side of the hollow post, wherein the upper end of the elongated jaw member is disposed to swing in an arc while pivoting at the hinged lower end; and a latch disposed near the upper end of the hollow post for retaining the upper end of the elongated jaw member against the first exterior side of the hollow post after the safety fencing is placed against the first exterior side of the hollow post and substantially at a right angle to the hollow post, clamping the safety fencing between the first exterior side of the hollow post and the elongated jaw member.

27. A reusable fence post for supporting roll-up safety fencing around an excavation or construction site, comprising:

an elongated post having a first longitudinal axis, a first predetermined length between an upper end and a bottom end, a first exterior side and a predetermined cross section and at least first and second pipe sections having a predetermined inside diameter attached to a second side of the elongated post and disposed lengthwise along the first longitudinal axis of the elongated fence post between a midpoint of the predetermined length and a bottom end of the predetermined length of the elongated post;

a stake formed of solid metal rod and having a cap formed of a third pipe section having the predetermined diameter attached over an upper end of the stake, the stake extending downward a second predetermined length along a second longitudinal axis from the cap wherein the stake passes through and moves freely within the at least first and second pipe sections and extends downward and outward through the lower one of the at least first and second pipe sections and wherein a lower stop plate is secured orthogonal to and around the outward extending portion of the stake approximately bisecting the second predetermined length of the stake; and an elongated jaw member, of a length from a lower end to an upper end at least approximately two inches longer than a width of the safety fencing but not more than the first predetermined length of the elongated post, hinged at the lower end to the elongated post near the bottom end of the elongated post on the first exterior side of the elongated post, wherein the upper end of the elongated jaw member is disposed to swing in an arc between an open and a closed position while pivoting at the hinged lower end, wherein the safety fencing, when placed between the elongated post and the elongated jaw member, is clamped therebetween when the elongated jaw member is placed in the closed position.

28. The fence post of claim 27, further comprising:

a latching device disposed near the upper end of the elongated post for retaining the upper end of the elongated jaw member against the first exterior side of the elongated post after the safety fencing is placed against the first exterior side of the elongated post and disposed substantially at a right angle to the elongated post, clamping the safety fencing between the first exterior side of the elongated post and the elongated jaw member.

29. The fence post of claim 28, wherein the upper end of the elongated jaw member is configured to be received in a latching relationship with the latching device disposed on the upper end of the elongated post.

30. The fence post of claim 28, wherein the latching device comprises:

slotted extensions of first and second opposite sides of the elongated post adjoining the first exterior side of the elongated post and disposed at the top of the elongated post such that the slotted extensions are at least approximately parallel and opposite one another and extend past the first exterior side of the elongated post at the top of the elongated post, wherein the slots in each extension are disposed at a first ramp angle from the vertical and extending upward and away from the elongated post;

a sliding pin, laterally and freely passing through both slots and retained therein such that the sliding pin may be moved upward or downward in the slots, moving respectively upward and away from the first exterior side of the elongated post or downward and toward the first exterior side of the elongated post when the elongated jaw member, having a second ramp angle cut downward across its upper end on the side of the elongated jaw member facing the first exterior side of the elongated post wherein the second ramp angle is greater than the first ramp angle, is brought into contact with the sliding pin causing the sliding pin to move upward within the slots and along the second ramp angle of the elongated jaw member until the upper end of the elongated jaw member passes under the sliding pin allowing the sliding pin to then move downward along the outside of the elongated jaw member and toward the first exterior side of the elongated post and, the sliding pin being retained in position by gravity thereby holding the elongated jaw member against the first exterior side of the elongated post to retain the elongated jaw member in position to clamp the safety fencing to the elongated post.

31. The fence post of claim 27, wherein:

the elongated post is formed of 1"×1"×⅛" angle iron to provide an outside V-angle clamping surface as the first exterior side; and the elongated jaw member is formed of 1"×1"×⅛" angle iron to provide an inside V-angle clamping surface such that the outside V-angle clamping surface of the first exterior side of the elongated post is nested partially within the inside V-angle clamping surface of the elongated jaw member while clamping the safety fencing therebetween.

* * * * *